US011198053B2

(12) United States Patent
Park

(10) Patent No.: US 11,198,053 B2
(45) Date of Patent: Dec. 14, 2021

(54) FUNCTIONAL SHOES AND FUNCTIONAL DEVICE FOR FUNCTIONAL SHOES

(71) Applicant: Hong-Soon Park, Gimpo-si (KR)

(72) Inventor: Hong-Soon Park, Gimpo-si (KR)

( * ) Notice: Subject to any disclaimer, the term of this patent is extended or adjusted under 35 U.S.C. 154(b) by 54 days.

(21) Appl. No.: 16/677,168

(22) Filed: Nov. 7, 2019

(65) Prior Publication Data

US 2020/0147477 A1 May 14, 2020

(30) Foreign Application Priority Data

Nov. 9, 2018 (KR) ..... 10-2018-0137491

(51) Int. Cl.

| | |
|---|---|
| ***A63C 17/22*** | (2006.01) |
| ***A43B 5/16*** | (2006.01) |
| ***A43B 5/04*** | (2006.01) |
| ***A63C 17/06*** | (2006.01) |

(52) U.S. Cl.

CPC ..... *A63C 17/226* (2013.01); *A43B 5/0427* (2013.01); *A43B 5/1633* (2013.01); *A43B 5/1658* (2013.01); *A63C 17/06* (2013.01)

(58) Field of Classification Search

CPC ..... A63C 17/226; A63C 17/06; A63C 17/18; A63C 2017/0053; A43B 5/0427; A43B 5/1633; A43B 5/1641; A43B 5/1658; A43B 5/1628

See application file for complete search history.

(56) References Cited

U.S. PATENT DOCUMENTS

| | | | | |
|---|---|---|---|---|
| 1,802,116 A * | 4/1931 | Kinsley | ..... | A63C 1/00 280/7.13 |
| 3,526,976 A * | 9/1970 | Jacobs | ..... | A43C 15/162 36/100 |
| 5,393,077 A * | 2/1995 | Wanous | ..... | A43B 5/0417 280/11.231 |
| 5,662,338 A | 9/1997 | Steinhauser, Jr. | | |

(Continued)

FOREIGN PATENT DOCUMENTS

| | | |
|---|---|---|
| CN | 2510117 Y | 9/2002 |
| CN | 2832237 Y | 11/2006 |

(Continued)

OTHER PUBLICATIONS

Extended European Search Report from European Application No. 19207446.6, dated Apr. 14, 2020.

(Continued)

*Primary Examiner* — John D Walters
(74) *Attorney, Agent, or Firm* — Merchant & Gould P.C.

(57) ABSTRACT

A functional shoe includes a sole, a functional part to provide a specific function to the functional shoe, a fixing part provided to fix the functional part; and a coupling part provided to be coupled to the fixing part, and directly or indirectly coupled to the sole, at an opposite side to a side coupled to the fixing part. The fixing part includes a fixing body provided to be coupled to the functional part, and a leg member formed to extend from the fixing body in a reference direction which is a direction facing the sole from the fixing body. The coupling part includes an insertion slot provided inside the coupling part to be open in a direction opposite to the reference direction such that the leg member is inserted into the insertion slot.

20 Claims, 20 Drawing Sheets

(56) References Cited

U.S. PATENT DOCUMENTS

| | | | | |
|---|---|---|---|---|
| 5,810,368 | A | 9/1998 | Steinhauser, Jr. | |
| 6,135,463 | A | 10/2000 | Wrike | |
| 6,460,864 | B1 * | 10/2002 | Shieh | A63C 17/18 280/11.19 |
| 8,567,794 | B2 | 10/2013 | Davis et al. | |
| 2007/0096408 | A1 * | 5/2007 | Yang | A63C 1/20 280/11.27 |
| 2011/0148054 | A1 | 6/2011 | Davis et al. | |
| 2013/0019502 | A1 | 1/2013 | Kwon | |
| 2019/0075883 | A1 | 3/2019 | Park | |

FOREIGN PATENT DOCUMENTS

| | | | |
|---|---|---|---|
| CN | 201019043 | Y | 2/2008 |
| CN | 201161098 | Y | 12/2008 |
| CN | 102834028 | A | 12/2012 |
| EP | 1086726 | A1 | 3/2001 |
| GB | 2221140 | A | 1/1990 |
| KR | 10-2009-0027543 | A | 3/2009 |
| KR | 20090012874 | U | 12/2009 |
| KR | 10-2015-0003647 | A | 1/2015 |
| KR | 10-1900613 | B1 | 9/2018 |
| WO | 2010/001351 | A2 | 1/2010 |

OTHER PUBLICATIONS

Notice of Allowance issued in Korean Application No. 10-2018-0137491, dated Feb. 25, 2020.

English translation of Korean Office Action from corresponding Korean patent application No. 10-2018-0137491, dated Nov. 15, 2019 (previously cited).

Korean Office Action from corresponding Korean patent application No. 10-2018-0137491, dated Nov. 15, 2019.

Chinese Office Action for Chinese Patent Application No. 201911087391.4 dated Mar. 3, 2021, 12 pages.

* cited by examiner

FUNCTIONAL SHOES AND FUNCTIONAL DEVICE FOR FUNCTIONAL SHOES

CROSS-REFERENCE TO RELATED APPLICATION

This application claims the benefit of priority to Korean Patent Application No. 10-2018-0137491, filed in the Korean Intellectual Property Office on Nov. 9, 2018, the entire contents of which are incorporated herein by reference.

TECHNICAL FIELD

The disclosure relates to functional shoes and a functional device for the functional shoes, which is applied to an outsole of the functional shoes to provide a specific function to the functional shoes.

BACKGROUND

Although shoes are originally intended to protect feet from external shocks or foreign objects, a specific function has been recently provided to the shoes and used. Alternatively, the shoes may have the specific function in the initial stage that the shoes are produced. For example, people going hiking have installed climbing irons on shoes to prevent sliding or shoes having wheels have been popular.

To give various functions to the functional shoes, there are required various functional devices, but these functional devices have been individually configured without being compatible with each other, so efficiency is degraded.

SUMMARY

The present disclosure has been made to solve the above-mentioned problems occurring in the prior art while advantages achieved by the prior art are maintained intact.

An aspect of the present disclosure provides a functional shoe, capable of selectively providing various functions, and a functional device for a functional shoe.

Another aspect of the present disclosure provides a functional device efficiently configured as functional devices include components compatible with each other.

Another aspect of the present disclosure provides a functional shoe and a functional device for the functional shoe, in which functional devices for the functional shoe are conveniently and durably coupled to or decoupled from each other.

The technical problems to be solved by the present disclosure are not limited to the aforementioned problems, and any other technical problems not mentioned herein will be clearly understood from the following description by those skilled in the art to which the present disclosure pertains.

According to an aspect of the present disclosure, a functional shoe includes a sole, a functional part to provide a specific function to the functional shoe, a fixing part provided to fix the functional part, and a coupling part provided to be coupled to the fixing part, and directly or indirectly coupled to the sole, at an opposite side to a side coupled to the fixing part.

The fixing part includes a fixing body provided to be coupled to the functional part, and a leg member formed to extend from the fixing body in a reference direction which is a direction facing the sole from the fixing body.

The coupling part includes an insertion slot provided inside the coupling part to be open in a direction opposite to the reference direction such that the leg member is inserted into the insertion slot.

According to another aspect of the present disclosure, a functional device for functional shoes includes a functional part to provide a specific function to the shoe, a fixing part provided to fix the functional part, and a coupling part provided to be coupled to the fixing part, and directly or indirectly coupled to the sole, at an opposite side to a side coupled to the fixing part.

The fixing part includes a fixing body coupled to the functional par, and a leg member formed to extend from the fixing body in a reference direction which is a direction facing the sole from the fixing body.

The coupling part includes an insertion slot provided such that the leg member is inserted into the insertion slot by a specific length in the reference direction.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
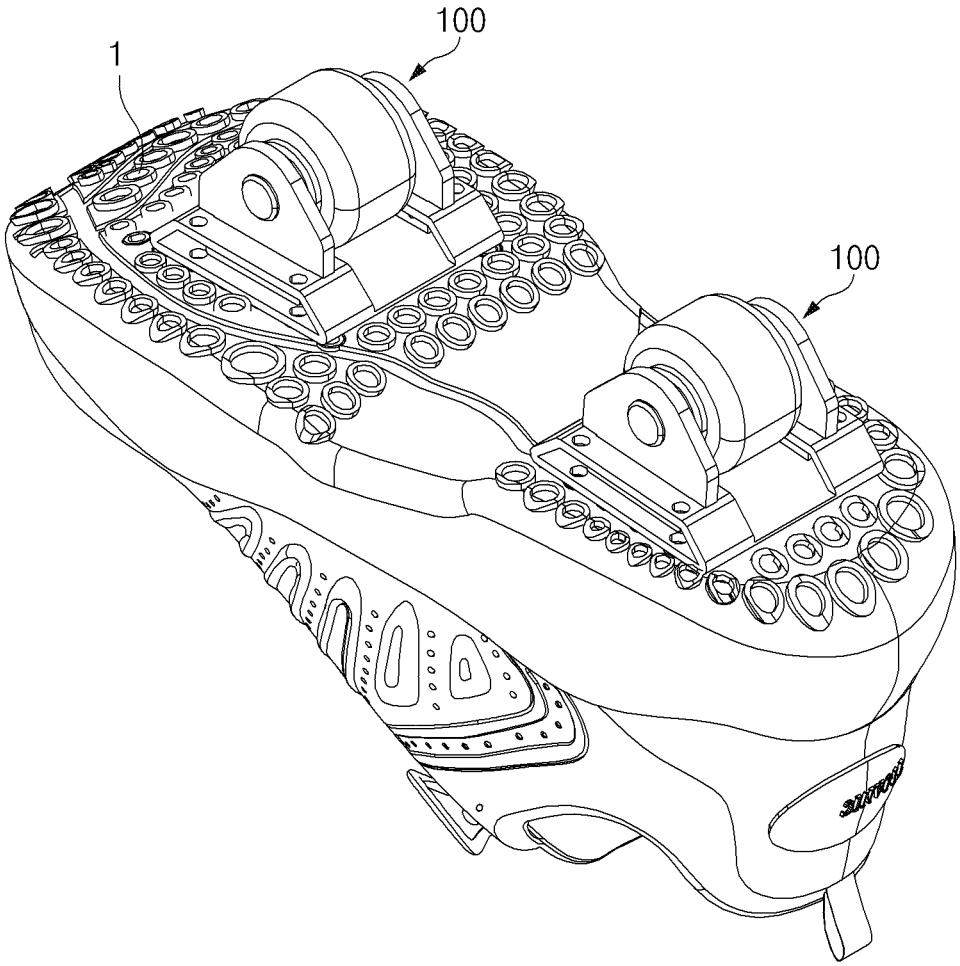
FIG. 1 is a perspective view of a functional shoe when viewed from the bottom of the functional shoe, according to a first embodiment of the present disclosure.

Hereinafter, some embodiments of the present disclosure will be described in detail with reference to the exemplary drawings. In adding the reference numerals to the components of each drawing, it should be noted that the identical or equivalent component is designated by the identical numeral even when they are displayed on other drawings. Further, in describing the embodiment of the present disclosure, a detailed description of well-known features or functions will be ruled out in order not to unnecessarily obscure the gist of the present disclosure.

Hereafter, "Front (F), "Rear (R)", "Left (Le)", Right (Ri)", "up (U)", and "down (L)" are defined as illustrated in accompanying drawings, but is provided only for the convenience of explanation. In this case, "Front (F), "Rear (R)", "Left (Le)", Right (Ri)", "up (U)", and "down (L)" may be defined in various manners.

First Embodiment

Figure 2:
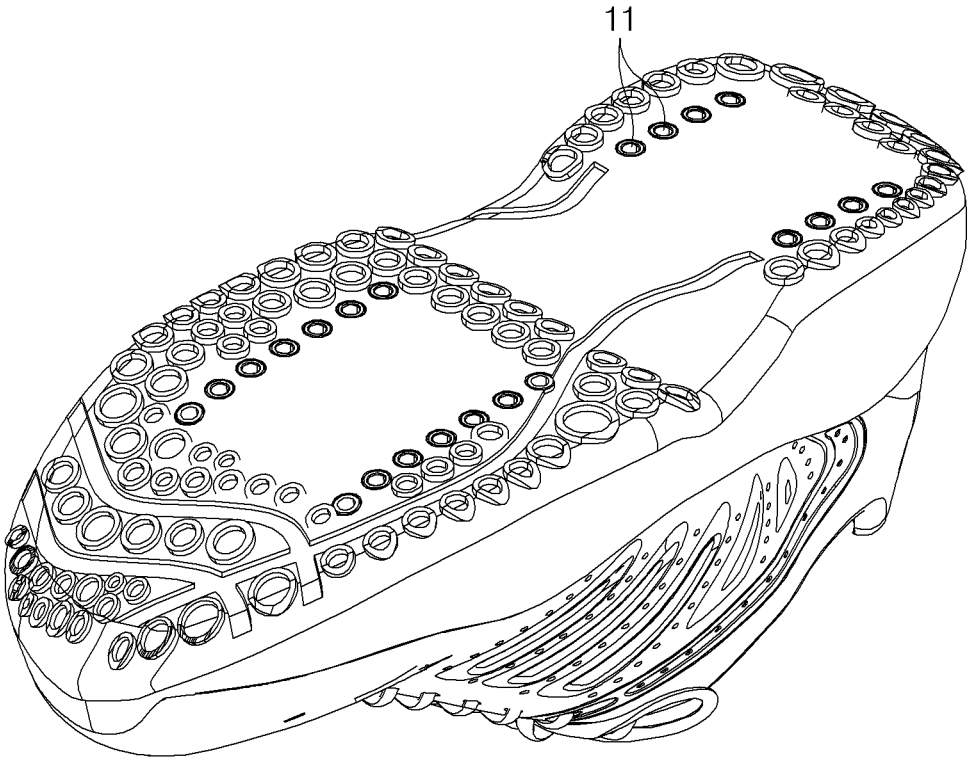
FIG. 2 is a perspective view of a functional shoe when viewed from the bottom of a sole of the functional shoe, according to the present disclosure.
Figure 3:
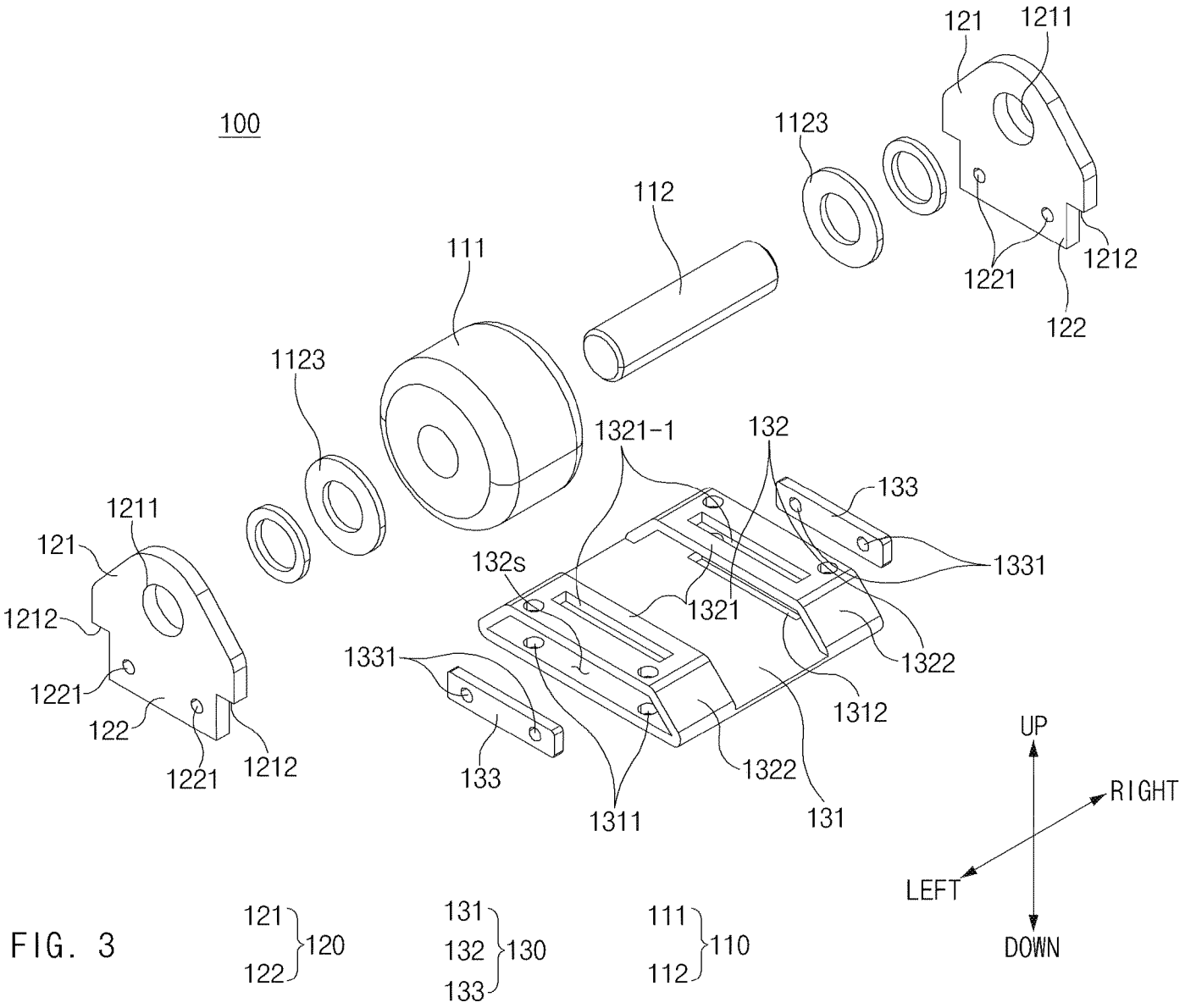
FIG. 3 is an exploded perspective view illustrating a functional device for the functional shoe, according to the first embodiment of the present disclosure.

FIG. 1 is a perspective view of a functional shoe when viewed from the bottom of the functional shoe, according to a first embodiment of the present disclosure, FIG. 2 is a perspective view of the functional shoe when viewed from the bottom of an outsole of the functional shoe, according to the present disclosure, and FIG. 3 is an exploded perspective view illustrating a functional device for the functional shoe, according to the first embodiment of the present disclosure.

The functional shoe according to the present embodiment includes a sole 1 and a functional device 100 detachably coupled to the sole 1 to provide a specific function to the functional shoe.

The functional device 100 may include a functional part 110, a fixing part 120, and a coupling part 130.

The functional part 110 may be provided to provide a specific function to the functional shoe.

The fixing part 120 may be provided to fix the functional part 110. The fixing part 120 may include a fixing body 121 and a leg member 122. The fixing body 121 may be provided to be coupled to the functional part 110. The leg member 122 may be formed to extend from the fixing body 121 in a reference direction, which is a direction from the fixing body 121 toward the sole 1.

The coupling part 130 is provided such that the fixing part 120 is coupled, and may be provided to be directly or indirectly coupled to the sole 1 at the opposite side of the side to which the fixing part 120 is coupled. The coupling part 130 may be provided to have an inner part to be open in a direction opposite to the reference direction, such that the leg member 122 is inserted into the coupling part 130.

Various types of functional devices 100 may be provided depending on the functions. For example, the functional device 100 may provide, to the functional shoe, any one of a roller skate function, anti-slip function, a skate function, or a spring function.

According to the conventional functional device for shoes, it is considered that a functional member (for example, rollers, springs, or skate blades) for directly providing functions is integrated with a coupling member for detachable coupling to the sole of the shoes. In this case, the coupling member has to be provided for each functional member. Therefore, there is a problem that the manufacturing cost of the functional member is high, and the functional members are not compatible with each other.

The present disclosure relates to a functional shoe including a replaceable functional device for shoes and more particularly relates to a functional shoe in which a coupling member is commonly used to couple the functional device for shoes to the sole and the functional member is selectively coupled. More specifically, according to the present embodiment, to improve the user's convenience by configuring the functional devices to be compatible with each other, the functional shoe includes a functional part to provide a function to the functional shoe, a fixing part to fix the functional part, and a coupling part to couple the fixing part with a sole, and have basic features in which the fixing part includes a leg member, and the coupling part includes an insertion slot in which the leg member is inserted.

Hereinafter, the feature of the functional shoe will be described in more detail according to the present embodiment.

Referring to FIG. 2, the sole 1 may include a plurality of fastening holes 11 to couple the coupling part 130.

A plurality of fastening holes 11 may be arranged in a front-rear direction of the sole 1. The plurality of fastening holes 11 may be arranged back and forth while being parallel to each other left and right.

The plurality of fastening holes 11 are arranged in the front and rear portions. Accordingly, when coupling the coupling part 130 to the sole 1, it is possible to change the position of the coupling part 130 relative to the sole 1 in the front-rear direction A plurality of coupling parts 130 may be coupled to the sole 1 in the front and rear portions of the sole 1. For example, one of two coupling part 130 may be coupled to the front portion of the sole 1, and a remaining one of the two coupling parts 130 may be coupled to the rear portion of the sole 1.

Functional Device 100

Referring to FIG. 1, according to the present embodiment, the functional device 100 may provide a roller function to the functional shoe.

Figure 4:
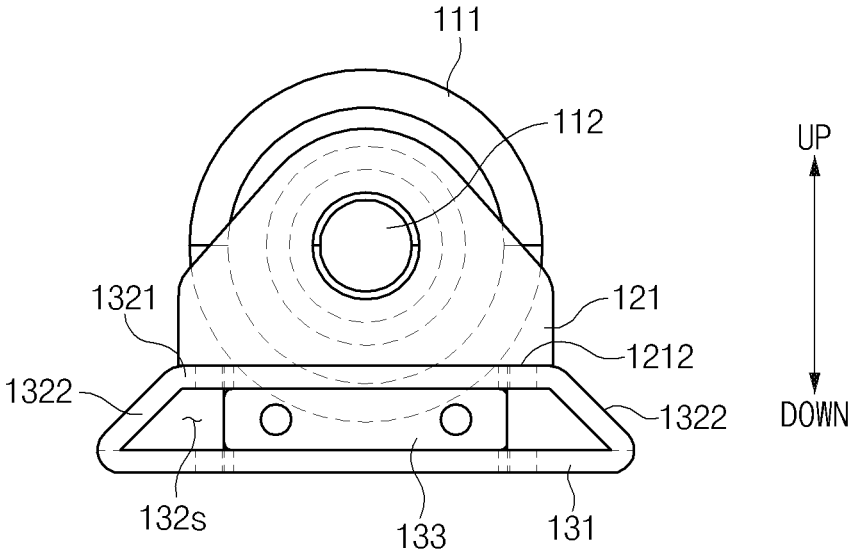
FIG. 4 is a side view of a functional device of FIG. 3.
Figure 5:
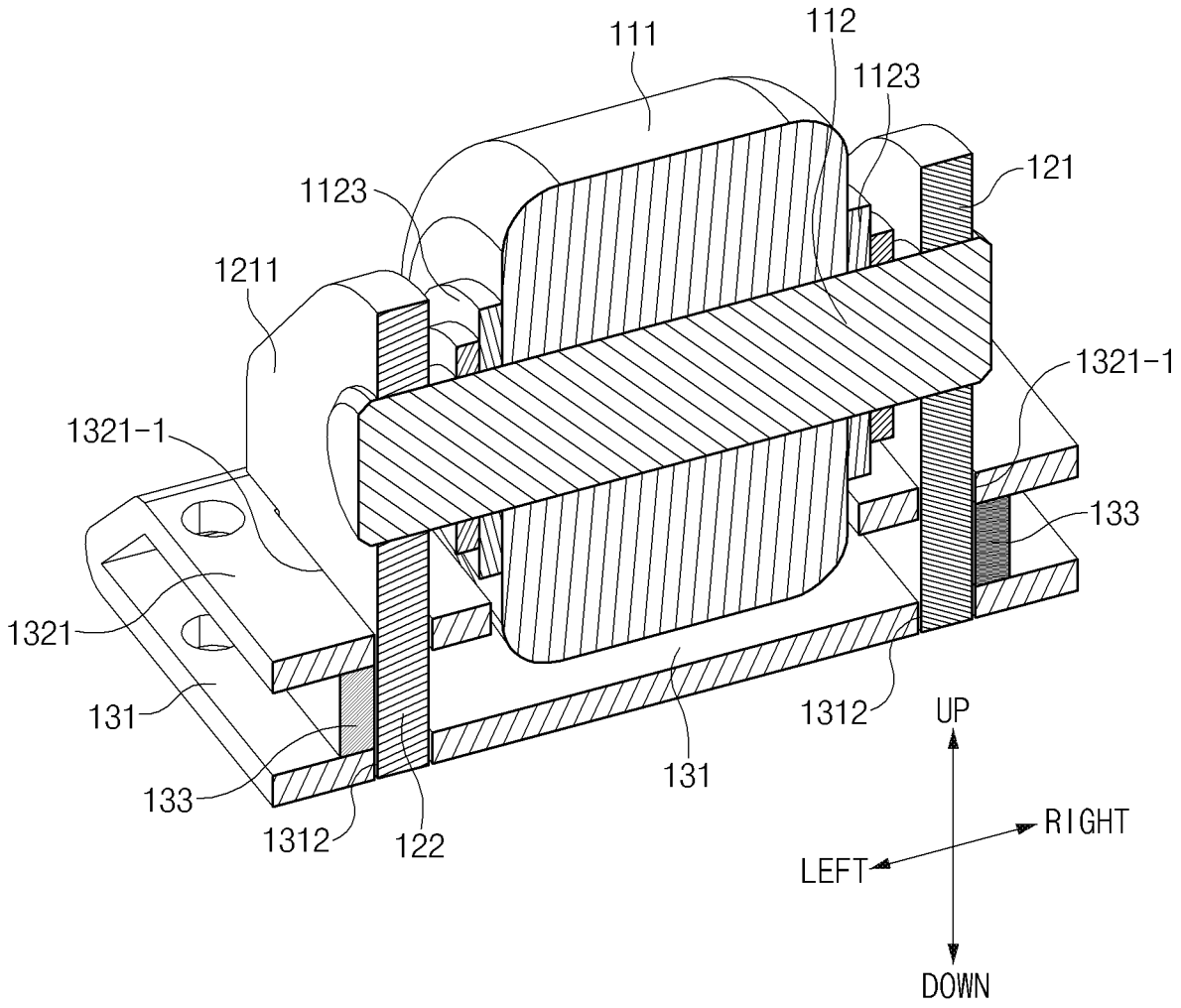
FIG. 5 is a sectional view of a functional device taken along line A-A' of FIG. 3
Figure 6A:
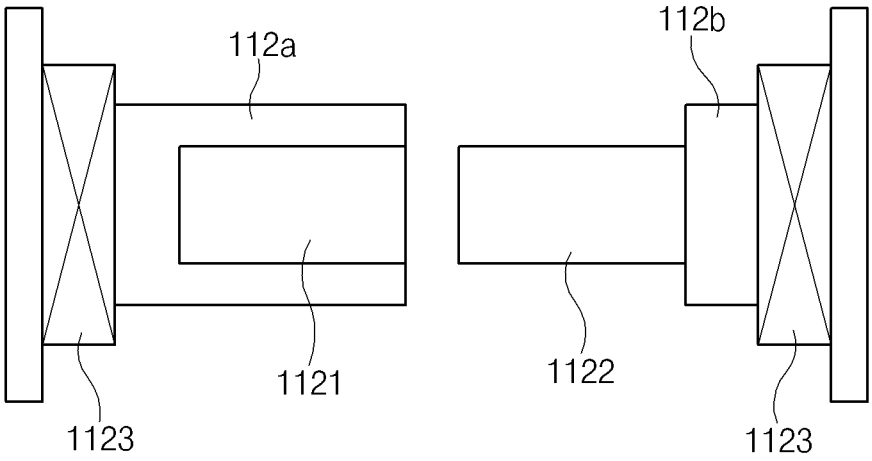
FIG. 6A is a view illustrating a roller shaft of FIG. 3.

FIG. 4 is a side view of the functional device of FIG. 3, FIG. 5 is a sectional view of the functional device taken along line A-A' of FIG. 3, and FIG. 6A is a view illustrating a roller shaft of FIG. 3.

The functional device 100 may include the functional part 110, the fixing part 120, and the coupling part 130.

Functional Part 110

In the present embodiment, the functional part 110 may include a roller 111 and a roller shaft 112.

The roller 111 may be provided to be pivotable about the roller shaft 112 serving as a rotating shaft.

Opposite ends of the roller shaft 112 may be coupled to a pair of fixing bodies 121, respectively.

Referring to FIG. 6A, in one embodiment, the roller shaft 112, which has a hollowed hole 1121, may include a shaft member 112*a*, which is coupled to any one of the pair of fixing bodies 121, and a second shaft member 112*b* which includes an insertion rod 1122 and is coupled to a remaining one of the pair of fixing bodies 121.

The second shaft member 112*b* may be coupled to the first shaft member 112*a* as the insertion rod 1122 is inserted into the hollowed hole 1121.

Each of the first shaft member 112*a* and the second shaft member 112*b* may include a bearing 1123 provided at the coupling portion with the fixing body 121.

The roller shaft 112 may be provided to rotate together with the roller 111 in the state of being coupled with the roller 111. To this end, the roller shaft 112 may include the bearing 1123 and thus may be rotatably installed on the pair of fixing bodies 121.

Fixing Part 120

The fixing part 120 may include a pair of fixing bodies 121 and a pair of leg members 122 coupled to the pair of fixing bodies 121, respectively.

The pair of fixing bodies 121 may be provided in the center thereof with shaft-through hole 1211 to be coupled to the roller shaft 112. Each of the pair of fixing bodies 121 may be provided in a shape in which the sectional area of the lower end is wider than the sectional area of the upper end thereof. In other words, the pair of fixing bodies 121 may have a shape including a portion in which the length of the front-rear direction is gradually increased when viewed from the top.

Referring to FIGS. 4 and 5, the pair of fixing bodies 121 are coupled to the sole 1 of the shoes in the state of being coupled with the roller 111. The sizes and the shapes of the fixing bodies 121 may be determined based on the size and the shape of the roller 111 to prevent the fixing bodies 121 from making contact with the ground surface when the roller 111 rotates in contact with the ground surface.

The leg member 122 may be provided to protrude downward from the fixing body 121. The leg member 122 may be provided integrally with the fixing body 121.

The leg member 122 may be provided in the shape having a specific length in the front-rear direction, having a specific width to the left-right directions, and extending in the up-down direction, and may be inserted in an insertion slot 1321-1 provided in the coupling part 130 to be described later.

The leg member 122 has a leg member through hole 1221 formed through the leg member 122 in the left-right direction, and thus may be fastened with an anti-separation member 133 to be described later.

A portion, which is connected with the leg member 122 of the fixing body 121, of the fixing part 120 may be formed to protrude out of the leg member 122 in a direction perpendicular to the reference direction, based on the reference direction which is the direction facing the sole 1.

In the present embodiment, the reference direction is the up-down directions, the portion, which is connected with the leg member 122, of the fixing body 121 may be provided in the shape of more protruding out of the leg member 122 in the front-rear direction, which is a direction perpendicular to the up-down direction.

According, a stepped portion 1212 is provided between the leg member 122 and the fixing body 121. Accordingly, after the fixing part 120 is inserted into the coupling part 130 by a specific length, the stepped portion 1212 makes contact with a seating portion 132 to guide the coupling position between the fixing part 120 and the coupling part 130.

Coupling Part 130

The coupling part 130 may include a coupling body 131, the seating portion 132, and the anti-separation member 133.

The coupling body 131 may be coupled directly or indirectly to the sole 1.

The coupling body 131 may be provided in a plate shape having a specific thickness. The coupling body 131 may include coupling body coupling holes 1311 for coupling with the sole 1.

The coupling body coupling holes 1311 may be provided to be formed through a plurality of places on the coupling body 131 in the up-down direction.

The seating portion 132 may be provided to protrude from the coupling body 131 in a direction opposite to the reference direction. In other words, the seating portion 132 may be provided to protrude upward from the coupling body 131.

The seating portion 132 may include a separation member 1321 and a connecting member 1322 to connect the separation member 1321 with the coupling body 131.

The separation member 1321 may be provided to be spaced apart from the coupling body 131 in the opposite direction of the reference direction to form a separation space 132*s* between the separation member 1321 and the coupling body 131. In other words, the separation member 1321 is provided to be spaced apart from the coupling body 131 in the upward direction to form the separation space 132*s* between the separation member 1321 and the coupling body 131.

The separation member 1321 is provided in a plate shape having a specific thickness in the up-down direction to extend by a specific length in the front-rear direction. The front and rear length of the separation member 1321 is provided to be shorter than the front and rear length of the coupling body 131. Accordingly, the coupling part 130 and the fixing part 120 are coupled to each other in the state that the fixing part 120 is coupled to the seating portion 132.

The separation member 1321 may be provided therein with the insertion slot 1321-1 in which the leg member 122 is inserted. The insertion slot 1321-1 may be provided in pair so that a pair of the leg member 122 may be inserted in each insertion slot 1321-1 respectively.

The insertion slot 1321-1 may be formed through an inner surface facing the separation space 132*s* of the separation member 1321 and an outer surface which is an opposite surface to the inner surface.

The insertion slot 1321-1 may extend in the front-rear direction with a specific length width in the left-right direction. The left and right width of the insertion slot 1321-1 may be formed to correspond to the left and right width of the leg member 122. The front and rear length of the insertion slot 1321-1 may be formed to be shorter than the front and rear length of the separation member 1321.

The insertion slot 1321-1 may have a length in the first direction perpendicular to the reference direction, and may have a width in the second direction perpendicular to the reference direction and the first direction. In other words, the insertion slot 1321-1 may have a length in the front-rear direction and a width in the left-right direction.

The leg member 122 is formed to be shorter than the insertion slot 1321-1 in the first direction and narrower than the insertion slot 1321-1 in the second direction, and thus may be provided to be inserted into the insertion slot 1321-1. In other words, the leg member 122 may be formed to be shorter than the insertion slot 1321-1 in the front-rear direction and to be narrower than the insertion slot 1132-1 in the left-right direction.

A portion, which is connected with the leg member 122, of the fixing body 121 is formed to be larger than the leg member 122 in at least one direction of the first direction and the second direction, to be prevented from being inserted into the insertion slot 1321-1. In other words the portion, which is connected with the fixing body 121, of the fixing body 121 is formed to be larger than the leg member 122 in at least one of the front-rear direction and left-right direction to be prevented from being inserted into the insertion slot 1321-1.

In the present embodiment, the portion, which is connected with the leg member 122, of the fixing body 121 is formed to be larger than the leg member 122 in the front-rear direction such that the fixing body 121 is prevented from being inserted into the insertion slot 1321-1.

According, the coupling position of the fixing part 120 and the coupling part 130 in the up-down direction may be guided.

The connecting member 1322 may connect the separation member 1321 with the coupling body 131. The connecting members 1322 may be provided at the front and rear ends of the separation member 1321. The connecting member 1322 may connect the front and rear ends of the separation member 1321 with the coupling body 131, respectively.

Referring to FIG. 4, when viewed from one side, the separation member 1321, the connecting member 1322 and the coupling body 131 may be provided to form a trapezoidal shape.

When the separation member 1321 is formed with the same length as the front-rear direction length of the coupling body 131, and when the fixing part 120 receives the force in the front-rear direction in the state in which the fixing part 120 is coupled to the coupling part 130 is coupled, the seating portion 132 may be easily deformed.

According to the present embodiment, when the front and rear length of the separation member 1321 is provided to be shorter than the front and rear length of the coupling body 131, even if force is applied to the fixing part 120 in the state the fixing part 120 is coupled to the coupling part 130, the force is dispersed by the seating portion 132, so the fixing part 120 may be stably supported by the coupling part 130.

The coupling part 130 may further include an anti-separation member 133.

The anti-separation member 133 may be coupled to the side surface of the portion, which is inserted into the separation space 132*s* through the insertion slot 1321-1, of the leg member 122. When the leg member 122 is separated from the insertion slot 1321-1 in the direction opposite to the reference direction, the anti-separation member 133 is locked to the inner surface of the separation member 1321 to prevent the leg member 122 from being separated. In other words, the anti-separation member 133 may prevent the leg member 122 from being separated from the insertion slot 1321-1.

The separation space 132*s* is formed to be open in the direction, in which the side surface, which is coupled to the anti-separation member 133, of the leg member 122 faces, to allow the anti-separation member 133 to be inserted into the separation space 132*s* while facing the side surface from the outside of the seating portion 132. In other words, the seating portion 132 may be open at the side surface thereof to allow the anti-separation member 133 to be inserted into the separation space 132*s* of the seating portion 132, and the anti-separation member 133 may be coupled to the side surface, which is inserted into the separation space 132*s* through the insertion slot 1321-1, of the leg member 122.

The anti-separation member 133 may include an anti-separation member coupling hole 1331 for coupling with the leg member 122. The anti-separation member 133 and the leg member 122 may be coupled to each other by a fastening member.

The coupling body 131 has a groove or a hole formed in a position corresponding to the insertion slot 1321-1, so that the front end of the leg member 122 inserted into the insertion slot 1321-1 is able to be inserted. A coupling body slot part 131 may be provided at a position corresponding to the insertion slot 1321-1 in the coupling body 131 to have a shape corresponding to the insertion slot 1321-1.

Accordingly, the front end of the leg member 122 inserted through the insertion slot 1321-1 is inserted into a coupling body slot portion 1312, such that the coupling force between the fixing part 120 and the coupling part 130 may be improved.

Figure 6B:
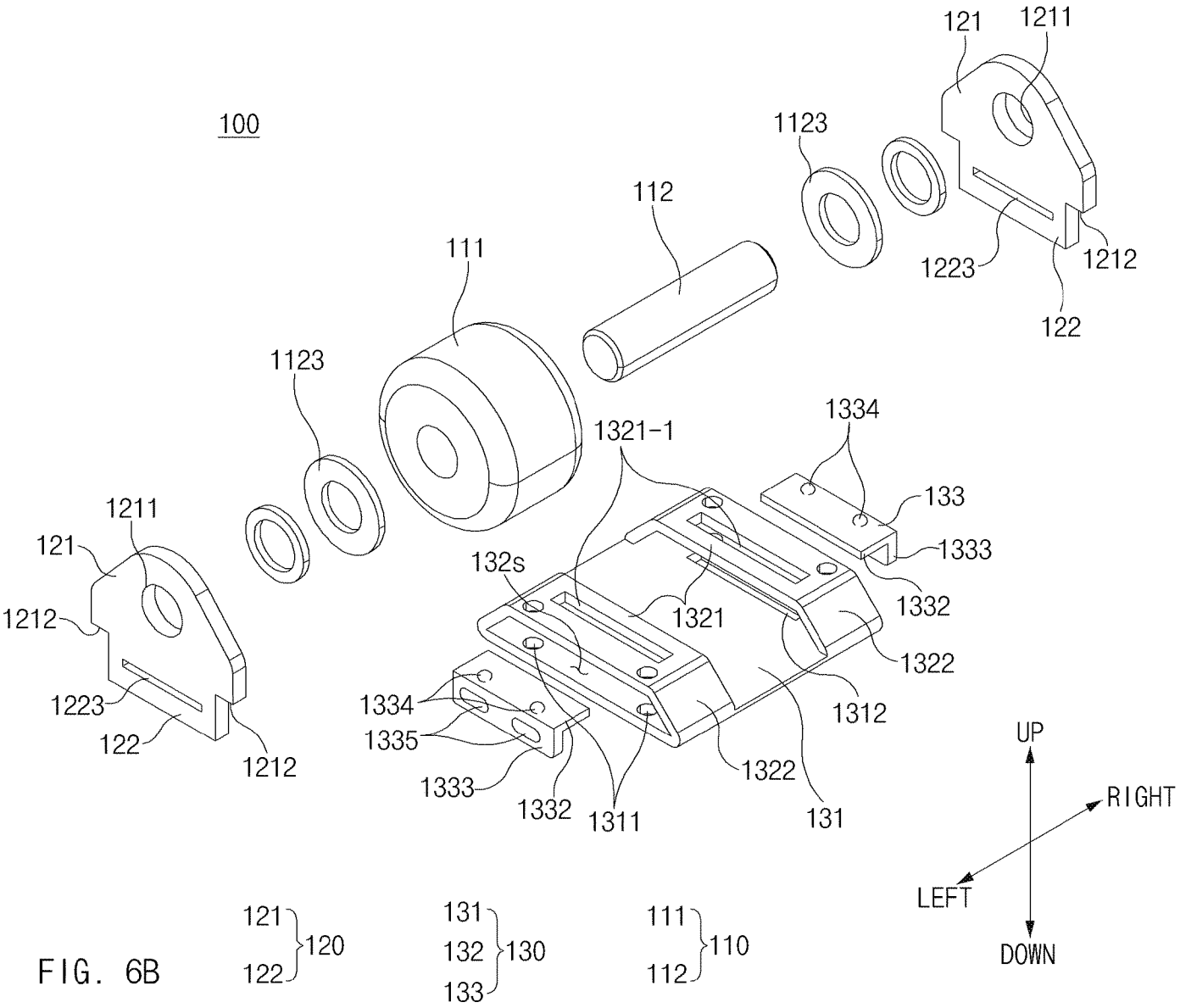
FIG. 6B is a view illustrating the modification of some of components of the functional shoe, according to the first embodiment of the present disclosure.

FIG. 6B is a view illustrating the modification of some of components of the functional shoe, according to a first embodiment of the present disclosure.

Referring to FIG. 6B, an anti-separation member slot 1223 may be formed in a portion, which is inserted into the separation space 132*s* through the insertion slot 13211-1, of the leg member 122. The anti-separation member 133 may pass through the anti-separation member slot 1223 to be coupled to the leg member 122.

An anti-separation protrusion 1334 may be provided on one surface of the anti-separation member 133 to protrude toward the inner surface of the separation member 1321, and an anti-separation groove (not illustrated) is provided in the inner surface of the separation member 1321 to receive the anti-separation protrusion 1334, thereby preventing the anti-separation member 133 from being separated from the anti-separation member slot 1223 to be decoupled from the leg member 122. The anti-separation protrusion 1334 is provided to have elasticity. Accordingly, when specific force is applied to separate the anti-separation member 133 from the leg member 122, the anti-separation protrusion 1334 is elastically deformed, so the anti-separation member 133 may be separated from the leg member 122. The anti-separation protrusion 1334 may be realized by utilizing an elastic member such as a spring.

The anti-separation member 133 may include a horizontal extension portion 1332 extending in an insertion direction in which the anti-separation member 133 is inserted into the separation space 132*s*, and a vertical extension portion 1333 extending from an outer end portion of the horizontal extension portion 1332 in the direction that is away from the separation member 1321. Accordingly, since the anti-separation member 133 may be separated when the vertical extension portion 1333 is gripped and pulled out, the anti-separation member 133 may be easily inserted and withdrawn. In addition, an anti-separation member hole 1335 may be formed in the vertical extension portion 1333 to more easily insert and withdraw the anti-separation member 133.

Figure 7:
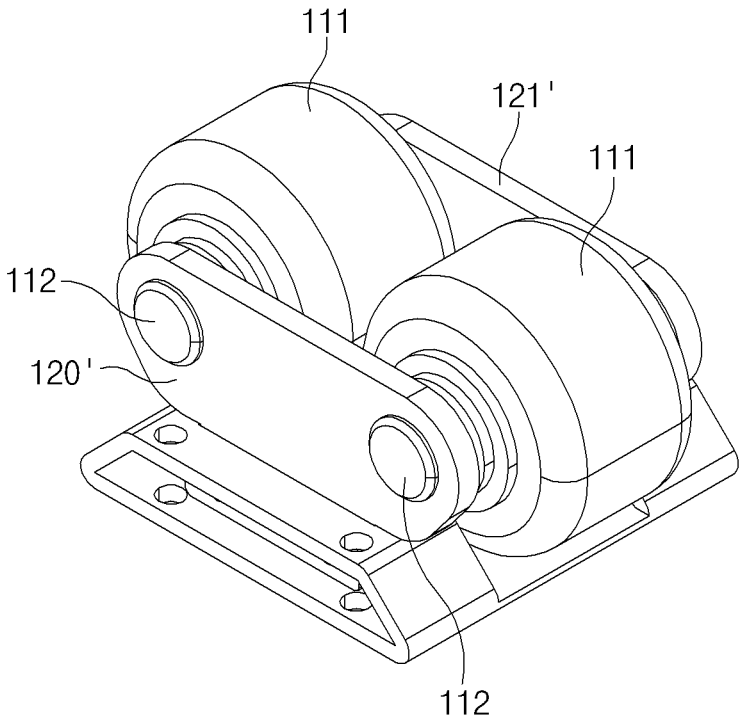
FIG. 7 is a view illustrating a functional device, according to a modification of the first embodiment of the present disclosure.

FIG. 7 is a view illustrating a functional device, according to a modification of the first embodiment of the present disclosure.

Referring to FIG. 7, the functional part 110 may include two rollers 111 and two roller shafts 112 coupled to the two rollers 111. The two rollers 111 and the two roller shafts 112 may be arranged back and forth.

A fixing part 120' may be provided such that two roller shafts 112 may be installed.

In addition, the description of the functional part 110 and the fixing part 120 made with respect to FIGS. 1 to 6A, and 6B will be applied to the description of the functional part 110 and the fixing part 120 according to the present embodiment.

The functional device 100 is detachably coupled to the functional shoe configured as described above. The functional shoe may be shoes having a roller function in the state that the functional device 100 is coupled to the functional shoe, and may be typical shoes in the state that the functional device 100 is decoupled from the functional shoe. In addition, since the decoupling from and the coupling to the functional device 100 is easily configured, a user may or may not use the roller function conveniently as necessary.

Second Embodiment

Figure 8:
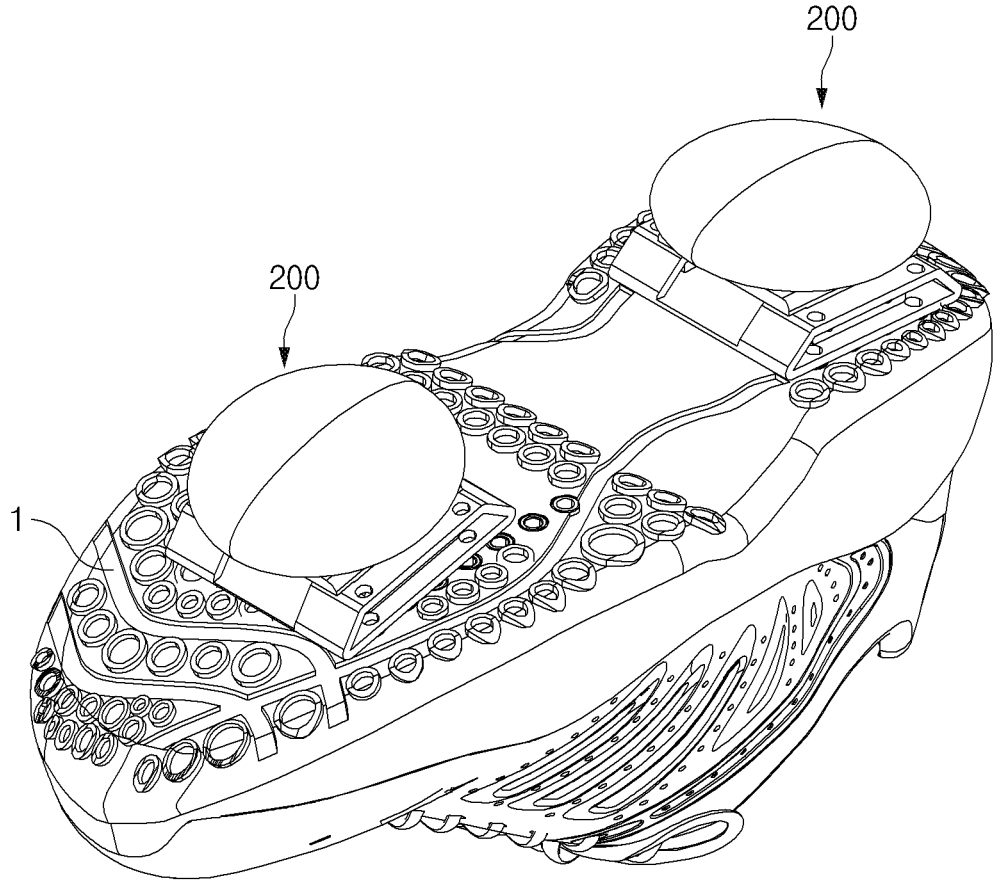
FIG. 8 is a perspective view of a functional shoe when viewed from the bottom of the functional shoe, according to a second embodiment of the present disclosure.
Figure 9:
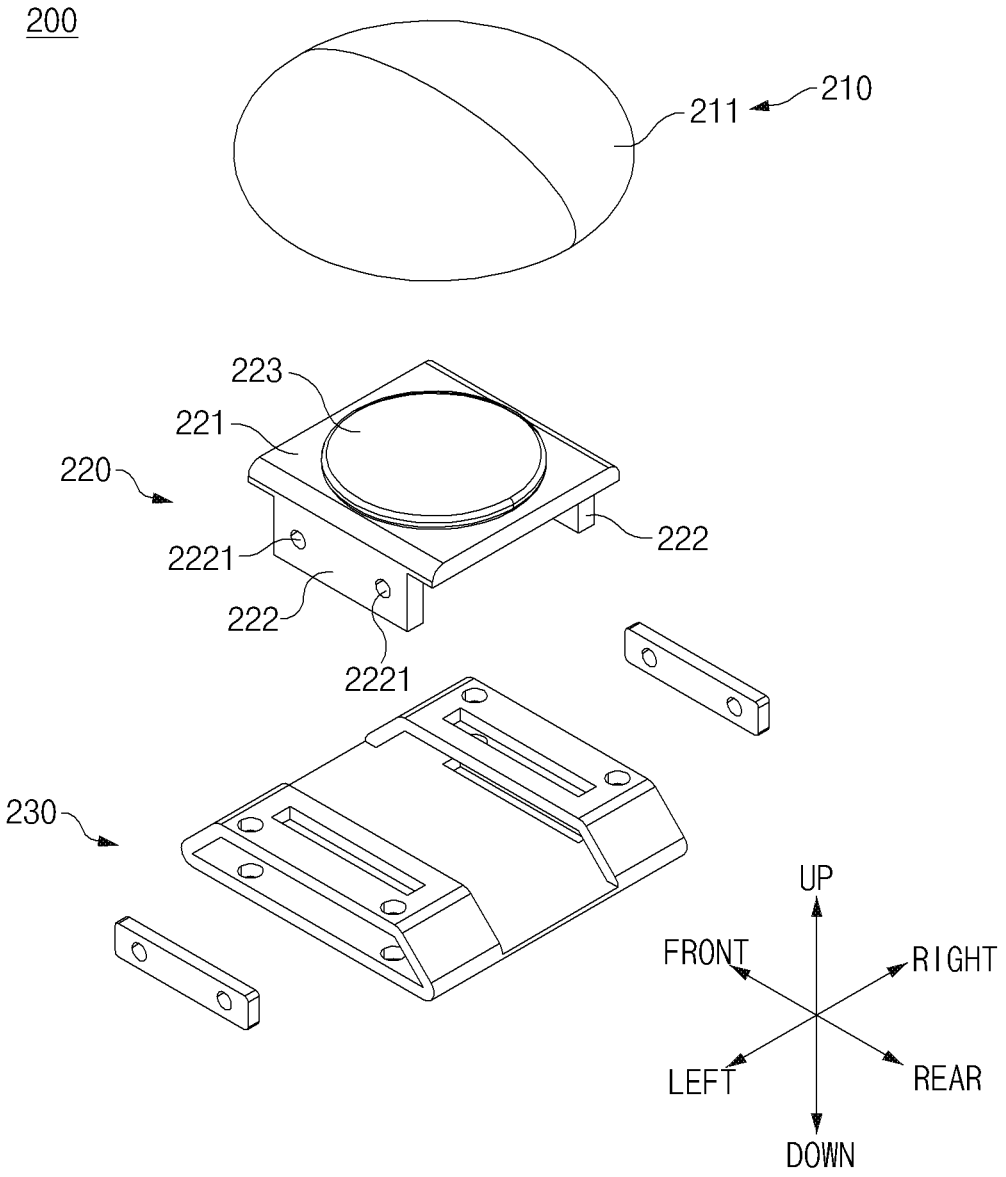
FIG. 9 is an exploded perspective view of a functional device of a functional shoe, according to a second embodiment of the present disclosure.

FIG. 8 is a perspective view of a functional shoe when viewed from the bottom of the functional shoe, according to a second embodiment of the present disclosure, and FIG. 9 is an exploded perspective view of a functional device 100 of the functional shoe, according to the second embodiment of the present disclosure.

The functional shoe according to the second embodiment is different from the functional shoe according to the first embodiment in the functional part and the fixing part of the functional device.

Referring to FIGS. 8 and 9, a functional device 200 may include a functional part 210, a fixing part 220, and a coupling part 230.

Functional Part 210

In the present embodiment, the functional part 210 may be provided to have an elastic body on the sole 1 of the functional shoe. The functional part 210 may include a pebble part 211.

The pebble part 211 may have an inner space, and a pebble part coupling hole may be formed in the pebble part 211 to allow the inner space to communicate with the outside. The pebble part 211 may be formed of an elastic material such that the pebble part coupling hole 2111 is elastically deformed.

The overall shape of the pebble part 211 is a disk shape, and the central portion thereof may be formed in a more convex-up shape.

Fixing Part 220

The fixing part 220 may include a fixing body 221, a pair of leg members 222, and a coupling plate 223.

The fixing body 221 may be formed in a plate shape having a specific thickness in an up-down direction.

The pair of leg members 222 may have a shape of extending by a specific length in the reference direction which is a direction facing the sole 1 from the fixing body 221. The pair of leg members 222 may be arranged to be spaced apart from each other in the left-right direction.

A portion, which is connected with the leg member 222, of the fixing body 221 is provided in a shape of protruding out of the leg member 222 in the front-rear direction and in the left-right directions, so the fixing part 220 is seated on the seating portion 232.

A coupling plate 223 may be provided to be spaced apart upward from the fixing body 221 by a specific distance. The coupling plate 223 may be provided to be inserted into the pebble part coupling hole. The coupling plate 223 may be provided in a disk shape having a specific thickness in the up-down direction.

The coupling plate 223 is formed with a diameter larger than the diameter of the pebble part coupling hole 2111, so the pebble part coupling hole 2111 is deformed such that the coupling plate 223 is inserted into the pebble part 211.

Meanwhile, the pebble part 211 may have an inner space such that the coupling plate 223 is received in the inner space. For example, the pebble part 211 may have an inner space corresponding to the shape and size of the coupling plate 223.

The coupling plate 223 may be connected with the fixing body 221 by a bridge part (not illustrated). The bridge part may extend by a specific length in the up-down direction, and may fix the coupling plate 223 to the fixing body 221 at a position at which the coupling plate 223 is spaced apart from the fixing body 221 by a specific length.

The overall shape of the bridge part may be formed to be in a cylindrical shape. The bridge part may be formed in size corresponding to or smaller than the diameter of the pebble part coupling hole 2111.

The coupling part 230 may be provided to be identical to the coupling part 130 according to the first embodiment. Therefore, the description of the coupling part 130 according to the first embodiment will be applied to the description of the coupling part 230.

The functional device 200 configured as described above may have the pebble part 211 coupled to be replaceable. When a user walks with shoes equipped with the functional device 200, the functional device 200 may induce a user to use force to keep balance. Therefore, when the user walks with shoes according to the present embodiment, the user may smoothly obtain workout effect.

Third Embodiment

Figure 10:
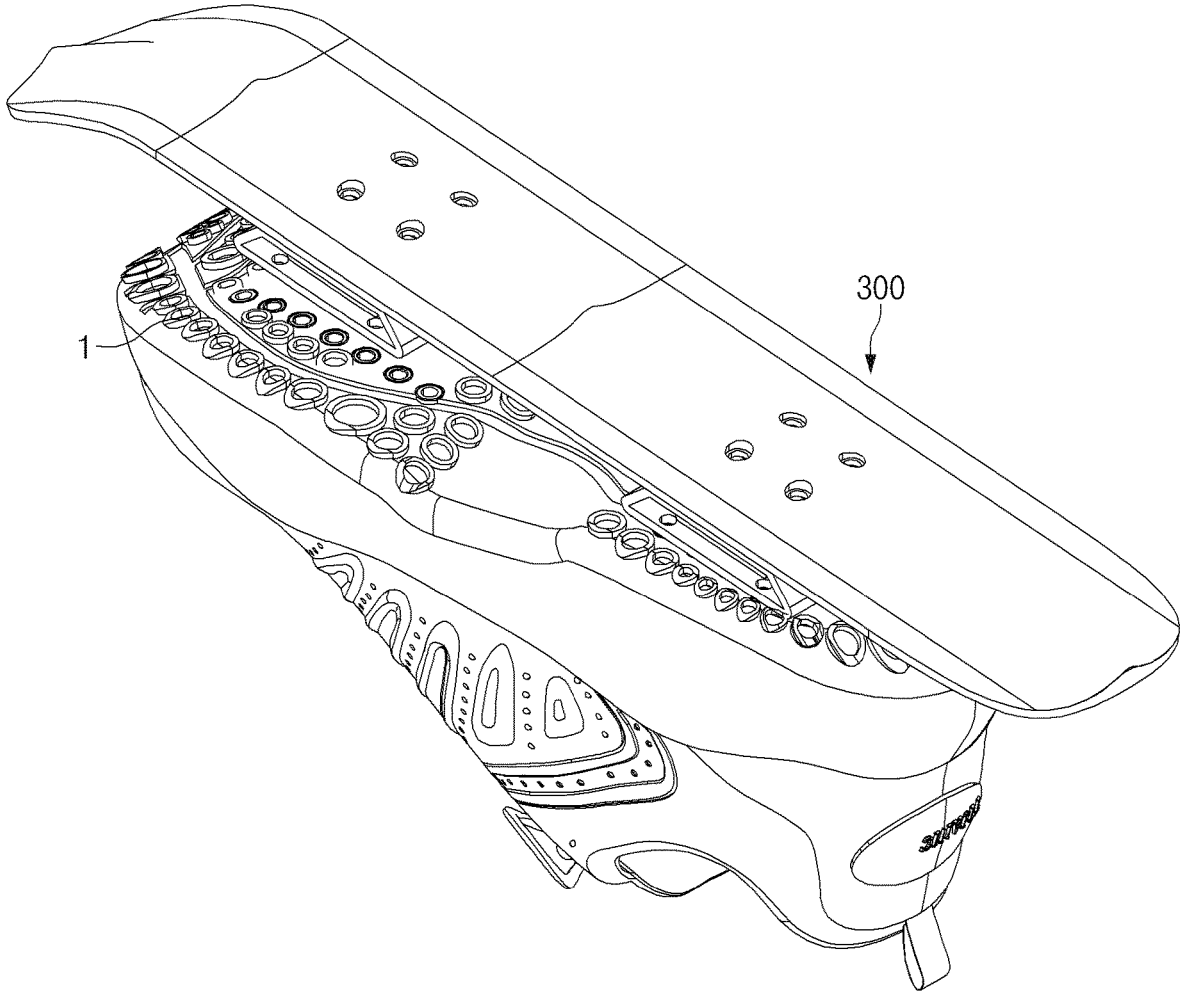
FIG. 10 is a perspective view illustrating a functional shoe when viewed from the bottom of the functional shoe, according to a third embodiment of the present disclosure.
Figure 11:
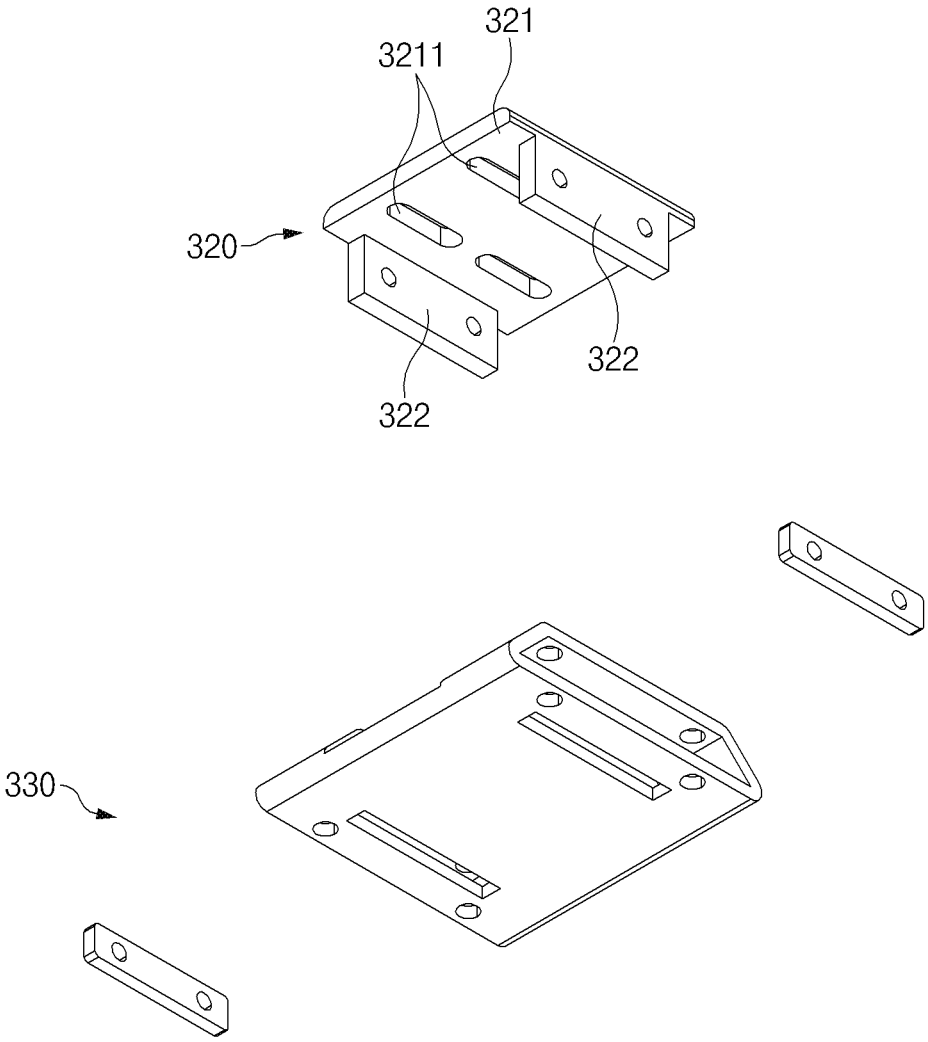
FIGS. 11 and 12 are views illustrating a functional device of a functional shoe, according to the third embodiment of the present disclosure.
Figure 12:
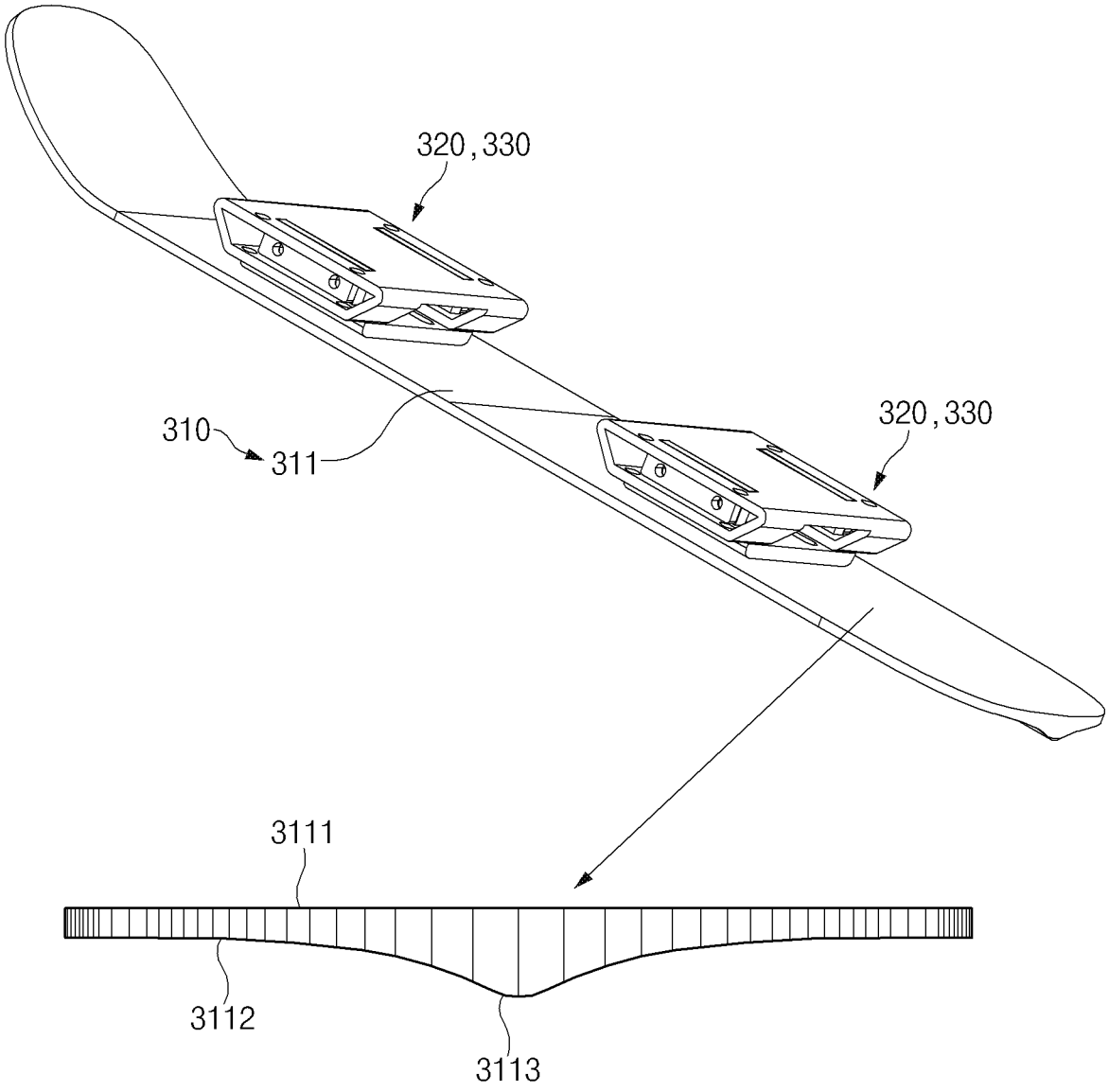

FIG. 10 is a perspective view illustrating a functional shoe when viewed from the bottom, according to the third embodiment of the present disclosure, and FIGS. 11 and 12 are views illustrating a functional device of a functional shoe, according to the third embodiment of the present disclosure.

The functional shoe according to the third embodiment is different from the functional shoe according to the first embodiment in the functional part and the fixing part.

A functional device 300 may include a functional part 310, a fixing part 320, and a coupling part 330.

Functional Part 310

In the present embodiment, the functional part 310 may include a sliding plate 311 to provide a sliding function to the functional shoe. The functional part 310 may include the sliding plate 311 to provide, to the functional shoe, a function such as skating or skiing.

A bottom plate 3111 of the sliding plate 311 may be coupled to the fixing part 320.

The sliding plate 311 is provided at the center of a top surface 3112 thereof with a mountain part 3113 protruding upward while extending in the front-rear direction, thereby improving a sliding effect when a user puts on shoes equipped with the functional device 300 on an ice.

The sliding plate 311 may be provided to be curved down at the front end thereof, so the sliding plate 311 may be provided in the shape similar to the shape of a skate blade or a ski plate. Accordingly, the sliding effect of the sliding plate 311 may be improved.

Fixing Part 320

Two fixing parts 320 may be spaced apart from each other in the front-rear direction of the sole 1.

Each fixing part 320 may include a fixing body 321 and a pair of leg members 322.

The fixing body 321 may be formed in a plate shape having a specific thickness in the up-down direction.

The pair of leg members 322 may be shaped to extend by a specific length in the reference direction, which is a direction facing the sole 1 from the fixing body 321. The pair of leg members 322 may be arranged to be spaced apart from each other in the left-right direction.

The portion, which is connected with the leg member 322, of the fixing body 321 is provided in a shape of protruding out of the leg member 322 in the front-rear direction and left-right direction such that the fixing part 320 is seated on the seating portion 332

Each fixing body 321 is formed therein with elongated holes 3211 extending in the front-rear direction of the sole 1. Accordingly, even if the spacing between the fixed parts 320 disposed in the front-rear direction is changed within a specific length, the sliding plate 311 may be coupled to the fixing parts 320.

The fixing part 320 may further include an auxiliary coupling member (not illustrated).

The auxiliary coupling member and the sliding plate 311 are fastened by a fastening member and may allow the sliding plate 311 to be coupled to the fixing body 321. Since the fixing body 321 has the elongated hole 3211 formed therein for the coupling of the sliding plate 311, when the elongated hole 3211 is directly coupled to the sliding plate 311, the coupling force between the fixing body 321 and the sliding plate 311 may be weakened due to the elongated hole 3211. Therefore, the sliding plate 311 is provided to be coupled to the fixing body 321 by the coupling between the auxiliary coupling member and the sliding plate 311, thereby improving the coupling force between the sliding plate 311 and the fixing body 321.

For example, the auxiliary coupling member is provided in the same plate shape as that of the anti-separation member 133 according to the first embodiment, so the auxiliary coupling member is formed at the center thereof with a coupling hole.

The auxiliary coupling member may be inserted into the space between the fixing body 321 and the coupling body 331 to make contact with the bottom surface of the fixing body 321. The space between the fixing body 321 and the coupling body 331 may be provided to be open in the front-rear direction so the auxiliary coupling member may be inserted into the space.

Coupling Part 330

Two coupling parts 330 may be spaced apart from each other in the front-rear direction of the sole 1.

Each coupling part 330 may be provided to be identical to the coupling part 130 according to the first embodiment. Therefore, the description of the coupling part 130 according to the first embodiment may be applied to the description of the coupling part 330.

In the functional device 300 configured as described above, the sliding plate 311 is maintained and applied to various sizes of shoes to provide the sliding function to the shoes. In other words, when the size of the shoes is different, the front-rear directional spacing between the fixing parts 320 may be changed, and the sliding plate 311 is fixed to the fixing parts 320 by the elongated holes 3211 formed in the fixing bodies 321.

Fourth Embodiment

Figure 13:
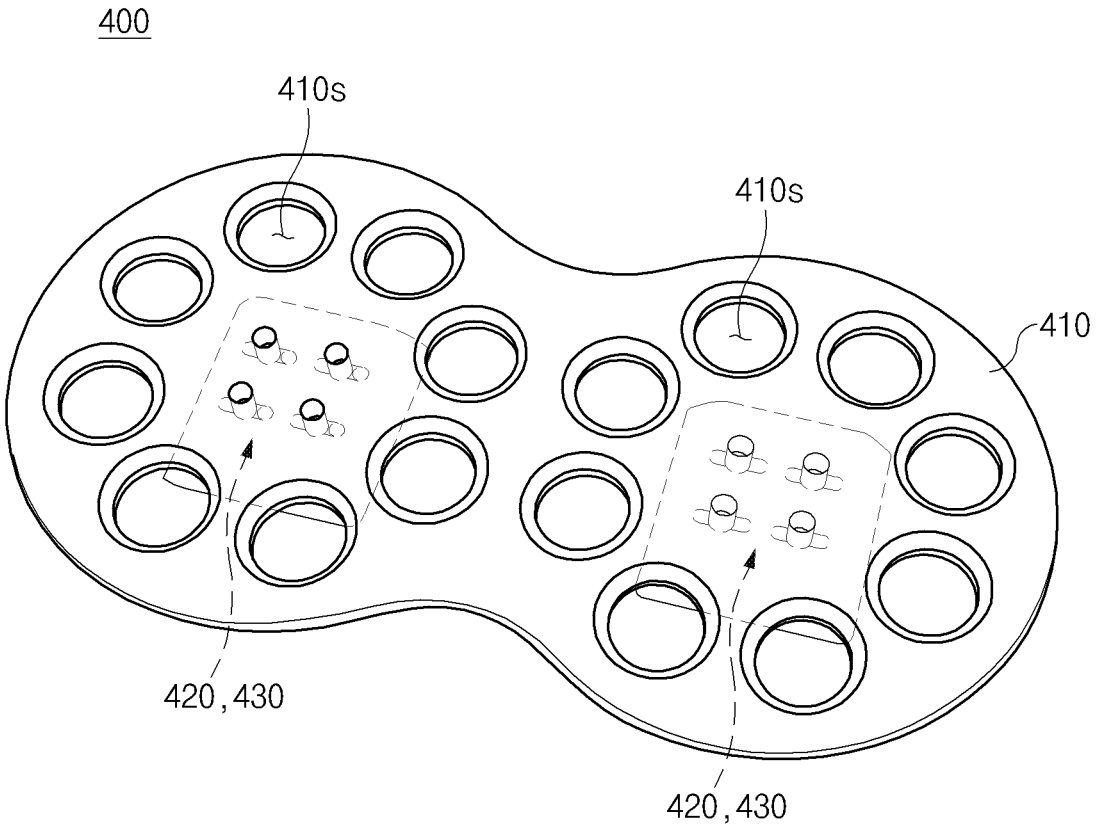
FIG. 13 is a view illustrating a functional device of a functional shoe, according to a fourth embodiment of the present disclosure.

FIG. 13 is a view illustrating a functional device of a functional shoe, according to a fourth embodiment of the present disclosure.

A functional shoe according to the fourth embodiment is different from the functional shoe according to the third embodiment in a functional part.

The functional part 410 according to the present embodiment may provide, to the functional shoe, a function allowing a user to walk without being stuck in snow. The functional part 410 may be provided to snow shoes or shoes having a snow cover function.

To this end, the whole shape of the functional part 410 is formed in the shape of a plate having a specific thickness and may be provided to have an area larger than the area of the soles 1. The functional part 410 may be provided in the center thereof with a plurality of holes 410*s*.

The functional part 410 may have a plurality of coupling holes 411 such that the functional part 410 is coupled to a fixing part 420.

Hereinafter, the description of the fixing part 320 according to the third embodiment will be applied to the description of the fixing part 420 according to the present embodiment.

Two coupling parts 430 may be provided on the sole 1 in the front-rear direction of the sole 1 while being spaced apart from each other.

Each coupling part 430 may be provided to be identical to the coupling part 130 according to the first embodiment. Therefore, hereinafter, the description of the coupling part 130 according to the first embodiment may be applied to the description of the coupling part 430.

The functional device 400 configured as described above may provide, to the shoes, the function of the snow shoes such that a user walks without being stuck in snow.

Fifth Embodiment

Figure 14:
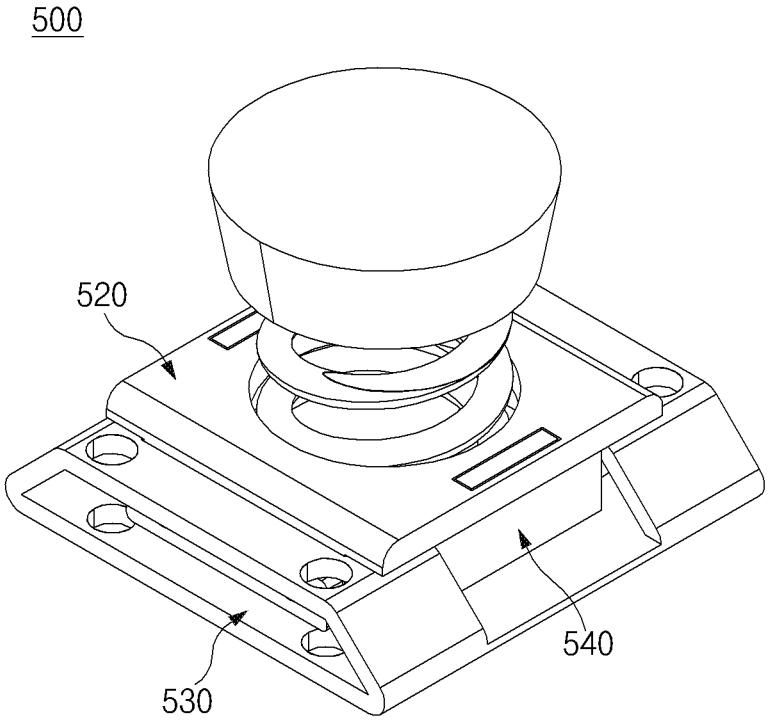
FIG. 14 is a view illustrating a functional device of a functional shoe, according to a fifth embodiment of the present disclosure.
Figure 15:
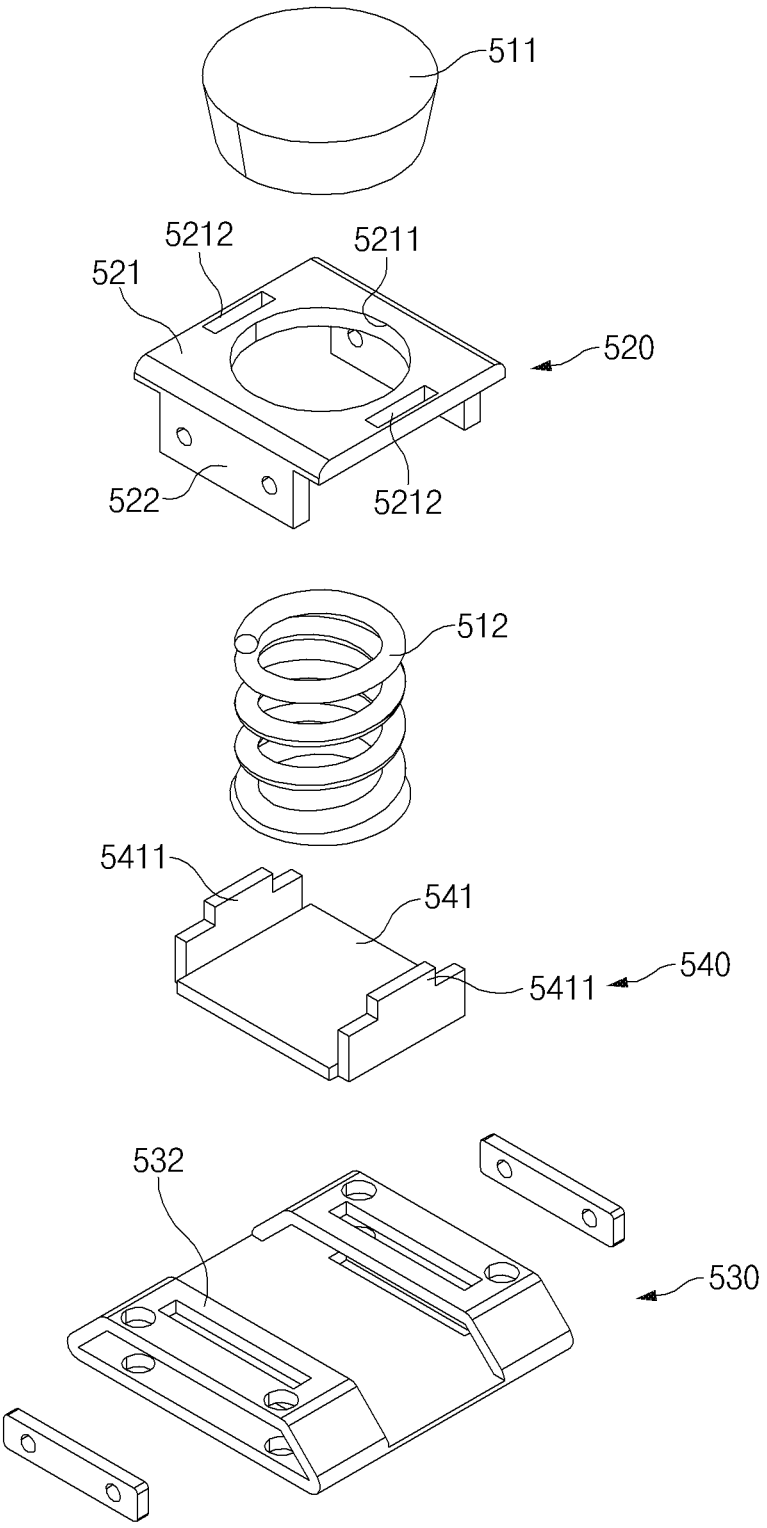
FIG. 15 is an exploded perspective view illustrating the functional device, according to the fifth embodiment of the present disclosure.
Figure 16:
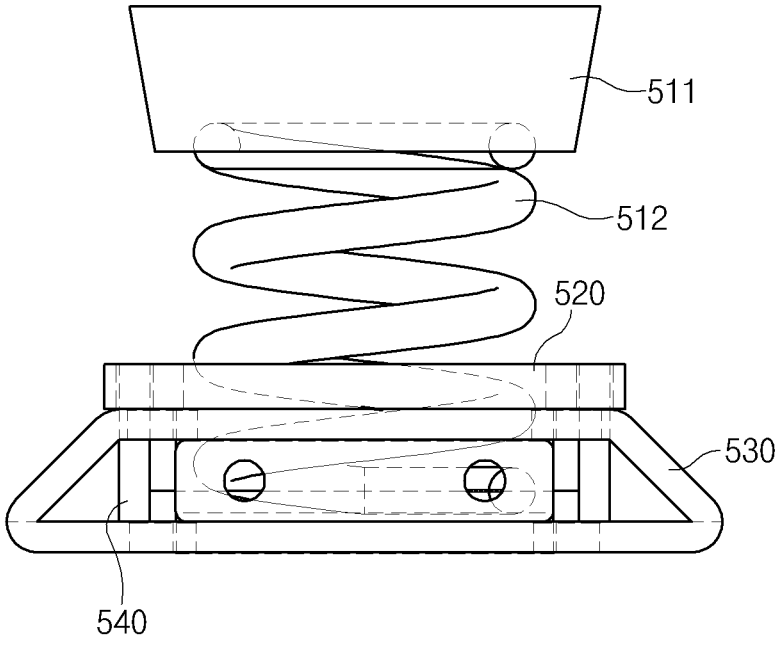
FIG. 16 is a side view of the functional device, according to the fifth embodiment of the present disclosure.

FIG. 14 is a view illustrating a functional device of a functional shoe, according to a fifth embodiment of the present disclosure, FIG. 15 is an exploded perspective view illustrating the functional device, according to the fifth embodiment of the present disclosure, and FIG. 16 is a side view of the functional device, according to the fifth embodiment of the present disclosure.

The functional shoe according to the fifth embodiment of the present disclosure is different from the functional shoe according to the first embodiment in a functional part and a fixing part.

Referring to FIGS. 14, 15, and 16, the functional device 500 may include a functional part 510, a fixing part 520, a sub-fixing part 540, and a coupling part 530.

Functional Part 510

In the present embodiment, the functional part 510 may include a cap 511 and an elastic body 512 to additionally provide an elastic force to the functional shoe.

The cap 511 may provide a contact surface with the ground surface.

One end of the elastic body 512 may be coupled to the cap 511, and an opposite end of the elastic body 512 may be coupled to the fixing part 520.

Fixing Part 520 and Sub-Fixing Part 540

A fixing part 520 may include a fixing body 521 and a leg member 522.

The fixing body 521 may be provided in the shape of a plate having a specific thickness in the up-down direction.

The pair of leg members 522 may be in the shape of extending by a specific length in a reference direction which is a direction from the fixing body 521 toward the sole 1. The pair of leg members 522 may be disposed to be spaced apart from each other in the left-right direction.

Portions, which are connected with the leg members 522, of the fixing body 521, may be provided in a shape of additionally protruding out of the leg members 522 in the front-rear direction and left-right directions, so the fixing part 520 is seated on a seating portion 532.

A sub-fixing part 540 may include a sub-fixing body 541 and fixing body coupling protrusion 5411.

The sub-fixing part 540 has a left-right directional width, which is narrower than the spacing between the leg members 522 of the fixing part 520, so the sub-fixing part 540 may be disposed in the space between the fixing part 520 and the coupling part 530.

The sub-fixing body 541 may be disposed in a space between the fixing body 521 and the coupling body 531. The sub-fixing body 541 may be coupled to one end of the elastic body 512 inserted into the space through an elastic through hole 5211 of the fixing body 521.

The fixing body coupling protrusions 5411 are provided in a shape of protruding toward the fixing body 521 from the sub-fixing body 541 and inserted into coupling protrusion insertion grooves 5212 formed in the fixing body 521. Accordingly, the fixing part 520 will be coupled to the sub-fixing part 540.

In one embodiment, the coupling part 530, the fixing part 520, and the sub-fixing part 540 may be fixed, as the fixing part 520 is coupled to the coupling part 530 in the state that the sub-fixing part 540 and the fixing part 520 are temporarily coupled to each other through the coupling between the coupling protrusion insertion groove 5212 and the fixing body coupling protrusion 5411.

The functional device 500 configured as described above may add the elastic force to the functional shoe, so the functional shoe may be provided for playing.

Sixth Embodiment

Figure 17:
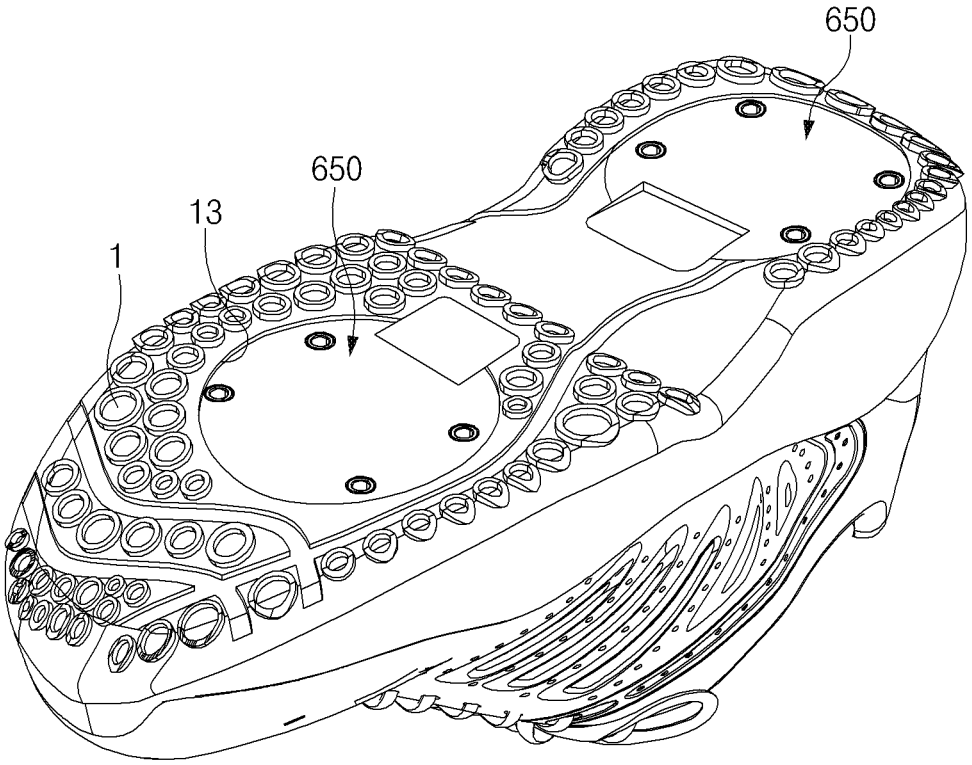
FIG. 17 is a perspective view illustrating a functional shoe when viewed from the bottom of the functional shoe, according to a sixth embodiment of the present disclosure.
Figure 18:
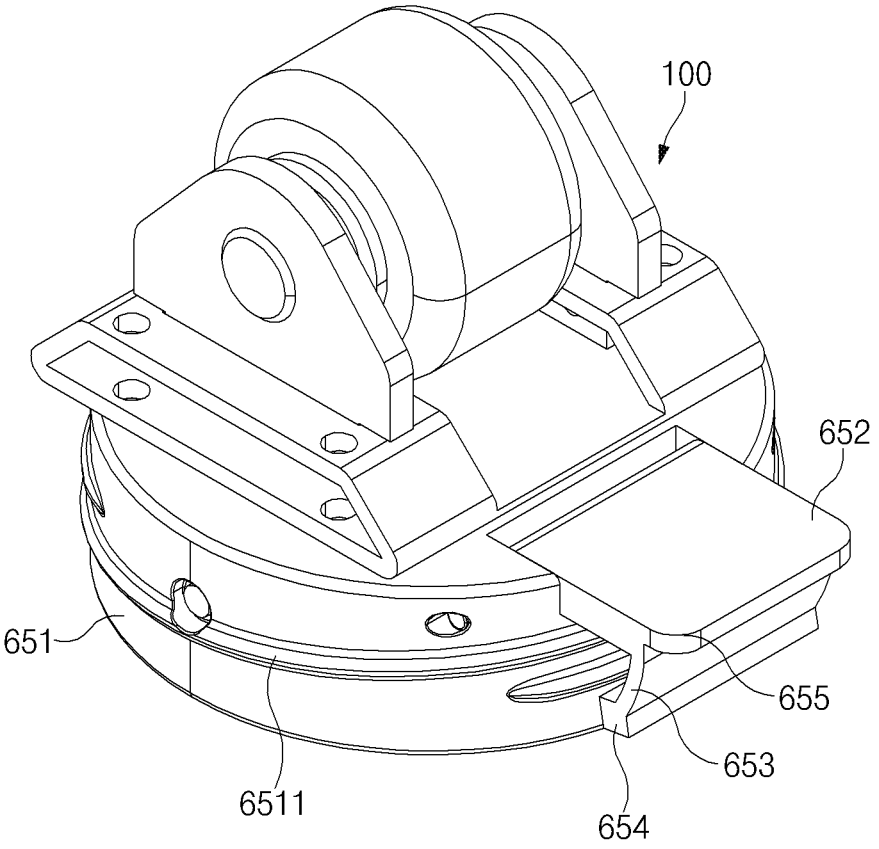
FIGS. 18 and 19 are views illustrating a coupling body part of the functional shoe, according to the sixth embodiment of the present disclosure.
Figure 19:
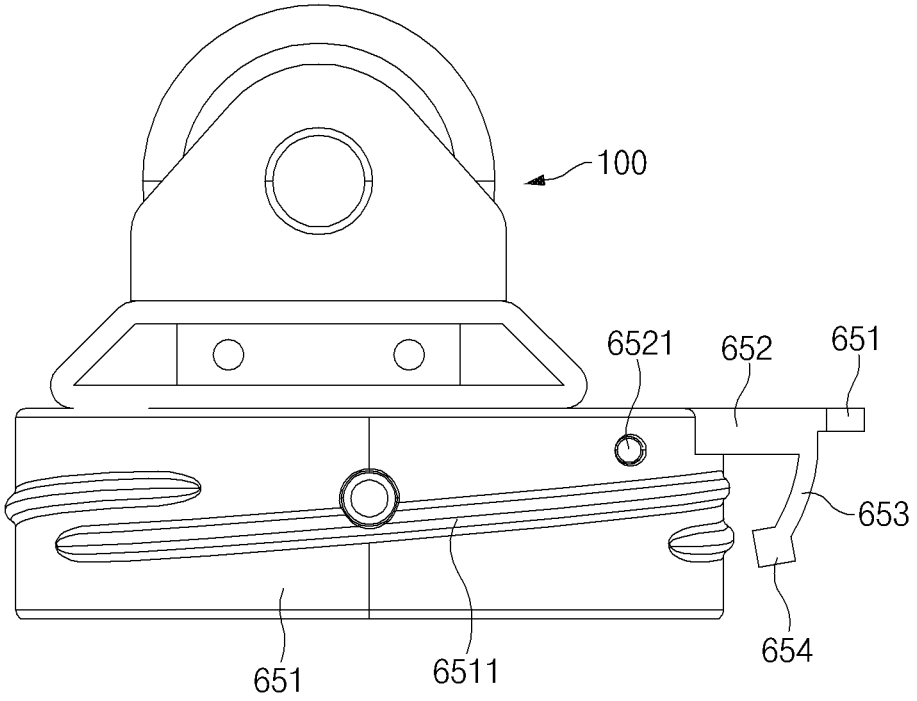

FIG. 17 is a perspective view illustrating a functional shoe when viewed from the bottom of the functional shoe, according to a sixth embodiment of the present disclosure, and FIGS. 18 and 19 are views illustrating a coupling body part of the functional shoe, according to the sixth embodiment of the present disclosure.

The functional shoe according to the sixth embodiment is different from the functional shoe according to the first embodiment in terms of additionally including a coupling body part 650 to mediate the coupling between the functional device and the sole.

In the present embodiment, the sole 1 may provide a receiving space to receive the coupling body part 650.

The coupling body part 650 may include a coupling body 651, an auxiliary lever 652, and a coupling protrusion 653.

The coupling body 651 refers to a body detachably coupled to the sole 1 of the functional shoe. Although it is illustrated that the coupling body 651 has a cylindrical shape in the present embodiment, the shape of the coupling body 651 is not specifically limited. The functional device and the auxiliary lever 652 are coupled to the coupling body 651.

The functional devices as described above may be applied to the functional device according to the present embodiment. Alternatively, other functional devices may be applied to the functional device according to the present embodiment.

The auxiliary lever 652 is rotatably coupled to the coupling body 651 toward the bottom surface of the sole 1. For example, the auxiliary lever 652 may be rotatably coupled to the coupling body 651 through a rotation shaft 6521 provided on one side thereof. Meanwhile, the shape of the auxiliary lever 652 is not specifically limited, but may be the shape of a flat plate extending along the bottom surface of the sole 1 from the rotation shaft 6501, based on when the coupling protrusion 653 is in the coupling position. When the sole is curved according to the type of shoes, the auxiliary lever 652 may also be formed to extend along the curve of the bottom surface.

In this case, the coupling protrusion 653 protruding toward the bottom surface of the sole 1 from the auxiliary lever 652 is coupled to the sole 1 such that the coupling protrusion 653 is decoupled from the sole 1 by moving between the coupling position and the decoupling position. The coupling position refers to the position at which the coupling protrusion 653 is coupled to the sole 1, and the decoupling position refers to the position at which the coupling position 653 is separated from the sole 1.

As the auxiliary lever 652 is rotated about the rotation shaft 6301, the coupling protrusion 653 may move between the coupling position and the decoupling position. When coupling protrusion 653 is in the coupling position, the coupling protrusion 653 may prevent the separation of the coupling body 651 due to the rotation of the coupling body 651 such that the coupling body 651 may be more firmly fixed to the sole 1.

Meanwhile, a locking portion 654 refers to a portion protruding in at least one of a direction from the coupling protrusion 653 toward the coupling body 651 and/or an opposite direction, based on when the coupling protrusion 653 is in the coupling position.

The locking portion 654 protrudes in at least one direction from the coupling protrusion 653 to have a thickness thicker than that of the coupling protrusion 653, thereby preventing the coupling protrusion 653 from being separated from the coupling position.

In addition, a protrusion 655 refers to a portion formed to protrude along the bottom surface of the sole 1 from the auxiliary lever 652, based on when the coupling protrusion 653 is in the coupling position.

When the coupling protrusion 653 is in the coupling position, the user may rotate the auxiliary lever 652 by applying a force to the protrusion 655 in a direction away from the sole 1, and may easily move the coupling protrusion 653 from the coupling position to the decoupling position. However, the number of the protrusions 655 and the position at which the protrusions 655 are formed are not specifically limited.

In this case, the sole 1 receives a first receiving part (not illustrated) formed to be recessed in the shape corresponding to the coupling protrusion 653, the locking portion 654, and the protrusion 655, and a second receiving part 13 formed to be recessed in the shape corresponding to the shape of the coupling body 651 to receive the coupling body 651. The first receiving part may include an area recessed inwardly beyond the protrusion 655 such that a user easily applies a force to the protrusion 655.

When the coupling protrusion 653 moves from the decoupling position to the coupling position to be received in the first receiving part, the first receiving part is pressed by the coupling protrusion 653 and the locking portion 654 to be elastically deformed, and then restored.

Meanwhile, the coupling manner between the coupling body 651 and the sole 1 is not specifically limited, but, for example, the coupling body 651 and the sole 1 may be coupled by a screw coupling manner. A male screw portion 6511 may be provided in any one of an inner side of the second receiving part 13 and an outer side of the coupling body 651, and a female screw portion corresponding to the male screw portion 6511 may be provided. As the coupling body 651 is screwed with the second receiving part 13, the coupling body part 650 may be detachably coupled to the sole 1 of the shoes.

According to the present disclosure, the functional shoe having the above-described components may be provided such that various functions are selectively to the functional shoe.

In addition, according to a functional shoe of the present disclosure, the functional devices providing a specific function to the functional shoe include components compatible with each other. Accordingly, when the functions provided to the functional shoe are changed, components to be replaced may be minimized, so efficient configuration is possible.

Therefore, according to the present disclosure, there may be provided the functional shoe and the functional device for the functional shoe, in which the functional device for the functional shoe is conveniently and durably coupled or decoupled.

The effects of the present disclosure are not limited to the above, but other effects, which are not mentioned, will be apparently understood to those skilled in the art.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A functional shoe comprising:

a sole;

a functional part to provide a specific function to the functional shoe;

a fixing part provided to fix the functional part; and a coupling part provided to be coupled to the fixing part, and directly or indirectly coupled to the sole, at an opposite side to a side coupled to the fixing part, wherein the fixing part includes:

a fixing body provided to be coupled to the functional part; and a leg member formed to extend from the fixing body in a reference direction which is a direction facing the sole from the fixing body; and wherein the coupling part includes an insertion slot provided inside the coupling part to be open in a direction opposite to the reference direction such that the leg member is inserted into the insertion slot, wherein the coupling part includes:

a coupling body directly or indirectly coupled to the sole; and a seating portion provided to protrude from the coupling body in the opposite direction to the reference direction, wherein the insertion slot is open in the opposite direction to the reference direction, inside the seating portion, and wherein the seating portion includes:

a separation member provided to be spaced apart from the coupling body in the opposite direction of the reference direction to form a separation space between the separation member and the coupling body; and a connecting member to connect the separation member with the coupling body, and wherein the insertion slot is formed through an inner surface, which is a surface facing the separation space of the separation member, and an outer surface which is a surface opposite to the inner surface.

2. The functional shoe of claim 1, wherein the coupling part further includes:

an anti-separation member coupled to a side surface of a portion, which is inserted into the separation space through the insertion slot, of the leg member, and locked to the inner surface of the separation member to prevent the leg member from being separated, when the leg member is separated from the insertion slot in the opposite direction to the reference direction.

3. The functional shoe of claim 2, wherein the separation space is formed to be open in a direction, in which the side surface, which is coupled to the anti-separation member, of the leg member faces, to allow the anti-separation member to be inserted into the separation space while facing the side surface from an outside of the seating portion.

4. The functional shoe of claim 3, wherein an anti-separation member slot is formed in the portion, which is inserted into the separation space through the insertion slot of the leg member, and wherein the anti-separation member passes through the anti-separation member slot to be coupled to the leg member.

5. The functional shoe of claim 4, wherein an anti-separation protrusion is provided on one surface of mutually facing surfaces of the anti-separation member and the separation member to be elastically deformed, and an anti-separation groove is formed in an opposite surface of the mutually facing surfaces to receive the anti-separation protrusion, such that the anti-separation member is prevented from being separated from the anti-separation member slot to be decoupled from the leg member.

6. The functional shoe of claim 4, wherein the anti-separation member includes:

a horizontal extension portion extending in an insertion direction in which the anti-separation member is inserted into the separation space; and a vertical extension portion extending from an outer end portion of the horizontal extension portion in a direction that is away from the separation member.

7. The functional shoe of claim 1, wherein the separation member extends together with the insertion slot in the front-rear direction of the sole, and is provided to be shorter than a length of the coupling body based on the front-rear direction of the sole.

8. The functional shoe of claim 1, wherein the coupling body has a groove or a hole, in a position corresponding to the insertion slot, such that a front end of the leg member inserted into the insertion slot is able to be inserted.

9. The functional shoe of claim 1, wherein the insertion slot has a length in a first direction perpendicular to the reference direction, and has a width in a second direction perpendicular to the reference direction and the first direction, wherein the leg member is formed to be shorter than the insertion slot in the first direction and to be narrower than the insertion slot in the second direction such that the leg member is provided to be inserted into the insertion slot, and wherein a portion, which is connected with the leg member, of the fixing body is formed to be larger than the leg member in at least one direction of the first direction and the second direction, to be prevented from being inserted into the insertion slot.

10. The functional shoe of claim 1, wherein the fixing part includes a pair of fixing bodies and a pair of leg members coupled to the pair of fixing bodies, respectively, wherein the coupling part includes a pair of insertion slots formed such that the pair of leg members are inserted into the pair of insertion slots, respectively, and wherein the functional part includes:

a roller; and a shaft supporting the roller pivotably and having opposite ends coupled to the pair of fixing bodies.

11. The functional shoe of claim 10, wherein the shaft includes:

a first shaft member including a hollowed hole and coupled to any one of the pair of fixing bodies; and a second shaft member including an insertion rod, coupled to the first shaft member as the insertion rod is inserted into the hollowed hole, and coupled to a remaining one of the pair of fixing bodies.

12. The functional shoe of claim 1, wherein the fixing part further includes:

a coupling plate be provided to be spaced apart in the opposite direction of the reference direction from the fixing body by a specific distance; and a bridge part to connect the fixing body with the coupling plate, and wherein the functional part includes:

a pebble part which is coupled to the coupling plate and has a convex surface making contact with a ground surface when the functional part is coupled to the sole.

13. The functional shoe of claim 12, wherein the pebble part has an inner space for receiving the coupling plate in a disc shape, and a coupling hole having a diameter smaller than a diameter of the coupling plate, and is formed of an elastic material allowing the coupling hole to be elastically deformed such that the coupling plate is able to be inserted into the inner space through the coupling hole.

14. The functional shoe of claim 1, further comprising:

a sub-fixing part interposed between the fixing part and the coupling part, wherein the functional part includes:

a cap having a surface making contact with a ground surface; and an elastic body including one end coupled to the cap and an opposite end coupled to the sub-fixing part through a hole formed in the fixing body.

15. The functional shoe of claim 14, wherein the sub-fixing part includes:

a sub-fixing body coupled to the elastic body; and fixing body coupling protrusions extending in the opposite direction of the reference direction from the sub-fixing body and inserted into coupling protrusion insertion grooves formed in the fixing body.

16. A functional shoe comprising:

a sole;

a functional part to provide a specific function to the functional shoe;

a fixing part provided to fix the functional part; and a coupling part provided to be coupled to the fixing part, and directly or indirectly coupled to the sole, at an opposite side to a side coupled to the fixing part, wherein the fixing part includes:

a fixing body provided to be coupled to the functional part; and a leg member formed to extend from the fixing body in a reference direction which is a direction facing the sole from the fixing body; and wherein the coupling part includes an insertion slot provided inside the coupling part to be open in a direction opposite to the reference direction such that the leg member is inserted into the insertion slot, wherein the fixing part includes:

first and second fixing parts spaced apart from each other in a front-rear direction of the sole, wherein the coupling part includes:

first and second coupling parts spaced apart from each other in the front-rear direction of the sole, wherein the functional part includes:

a sliding plate to provide, to the functional shoe, a sliding function, and wherein each of the first fixing body of the first fixing part and the second fixing body of the second fixing part has an elongated hole extending in the front-rear direction, such that the sliding plate is coupled to the first and second fixing parts even if a spacing between the first and second fixing parts is changed within a specific length.

17. The functional shoe of claim 16, wherein the sliding plate includes:

a mountain part provided at a center of an opposite surface to one surface that the first and second fixing parts face, protruding in the opposite direction to the reference direction from the opposite surface, and extending in the front-rear direction.

18. A functional shoe comprising:

a sole;

a functional part to provide a specific function to the functional shoe;

a fixing part provided to fix the functional part;

a coupling part provided to be coupled to the fixing part, and directly or indirectly coupled to the sole, at an opposite side to a side coupled to the fixing part;

a coupling body inserted into a receiving part provided in the sole and coupled to the sole to mitigate coupling between the coupling part and the sole;

an auxiliary lever rotatably coupled to the coupling body toward a bottom surface of the sole; and a coupling protrusion protruding toward the bottom surface of the sole from the auxiliary lever and detachably coupled to the sole, wherein the fixing part includes:

a fixing body provided to be coupled to the functional part; and a leg member formed to extend from the fixing body in a reference direction which is a direction facing the sole from the fixing body; and wherein the coupling part includes an insertion slot provided inside the coupling part to be open in a direction opposite to the reference direction such that the leg member is inserted into the insertion slot.

19. The functional shoe of claim 18, wherein a male screw portion is be provided in one of an inner surface of the receiving part and an outer surface of the coupling body, and a female screw portion is provided in a remaining one of the inner surface and the outer surface, such that the coupling body is screwed with the receiving part through rotation, and wherein the coupling protrusion moves to a position for coupling with the sole and is coupled to the sole, as the auxiliary lever rotates, such that separation resulting from the rotation of the coupling body is prevented.

20. A functional device for functional shoes coupled to a sole of a shoe to provide a function to the shoe, the functional device for functional shoes comprising:

a functional part to provide a specific function to the shoe;

a fixing part provided to fix the functional part; and a coupling part provided to be coupled to the fixing part, and directly or indirectly coupled to the sole, at an opposite side to a side coupled to the fixing part, wherein the fixing part includes:

a fixing body provided to be coupled to the functional part; and a leg member formed to extend from the fixing body in a reference direction which is a direction facing the sole from the fixing body;

wherein the coupling part includes an insertion slot provided such that the leg member is inserted into the insertion slot by a specific length in the reference direction, wherein the coupling part includes:

a coupling body directly or indirectly coupled to the sole; and a seating portion provided to protrude from the coupling body in the opposite direction to the reference direction, wherein the insertion slot is open in the opposite direction to the reference direction, inside the seating portion, wherein the seating portion includes:

a separation member provided to be spaced apart from the coupling body in the opposite direction of the reference direction to form a separation space between the separation member and the coupling body; and a connecting member to connect the separation member with the coupling body, and wherein the insertion slot is formed through an inner surface, which is a surface facing the separation space of the separation member, and an outer surface which is a surface opposite to the inner surface.

* * * * *